US005415194A

United States Patent [19]

Kaye

[11] Patent Number: 5,415,194

[45] Date of Patent: May 16, 1995

[54] SHEET SUPPORTING

[76] Inventor: Jonathan S. Kaye, 321 Columbus Ave., Boston, Mass. 02116

[21] Appl. No.: 927,139

[22] Filed: Aug. 7, 1992

[51] Int. Cl.[6] ..... F04H 15/54; F04H 15/64

[52] U.S. Cl. ..... 135/115; 135/87; 135/118; 135/119; 160/351

[58] Field of Search ..... 52/3, 4; 135/87, 115, 135/119, 118, 114, 89, 105, 107, 108, 905, 89; 5/417; 160/327, 354, 328, 329, 368.1, 370, 387, 390, 351, 135, 400

[56] References Cited

U.S. PATENT DOCUMENTS

| | | | |
|---|---|---|---|
| 1,871,101 | 8/1932 | Waltz | 135/119 |
| 2,296,358 | 9/1942 | Marinsky et al. | 135/87 |
| 2,521,768 | 9/1950 | Adams | 135/118 |
| 2,578,135 | 12/1951 | Holgaard et al. | 135/119 |
| 2,777,454 | 1/1957 | Kramer | 135/118 |
| 2,795,830 | 6/1957 | Leatherman | 135/119 |
| 2,804,633 | 9/1957 | Taylor et al. | 135/114 |
| 2,928,405 | 3/1960 | Lawson | 135/118 |
| 3,044,476 | 7/1962 | Avery | 135/105 |
| 3,162,920 | 12/1964 | Durham | 135/119 |
| 3,237,778 | 3/1966 | Hoodis | 160/354 |
| 3,590,864 | 7/1971 | Vechesloff | 135/119 |
| 4,685,484 | 8/1987 | Moneta | 135/87 |
| 4,750,508 | 6/1988 | Tatoian | 135/87 |

FOREIGN PATENT DOCUMENTS

| | | | |
|---|---|---|---|
| 0527450 | 10/1940 | United Kingdom | 135/5 |
| 0599882 | 3/1948 | United Kingdom | 135/15 |

*Primary Examiner*—Michael Safavi
*Attorney, Agent, or Firm*—Fish & Richardson

[57] ABSTRACT

The invention includes a securing structure comprising a first ring member, second and third ring members adjacent to the first ring member, a locking member, and a cord insertable through the second and third ring members, respectively, and engagable by the locking member. The invention also includes a free standing panel member comprising a panel; a plurality of ring members in the panel arranged in groups of at least three ring members adjacent one another; a plurality of support members; a plurality of anchoring members for accommodating the support members; and a plurality of cords each engagable by a locking member (e.g., a spring-actuated cord lock). A method of assembling the invention includes the steps of pushing an anchoring member into a surface sufficiently far to stabilize the anchoring member; inserting a support member through a collar into the anchoring member; placing the first ring member over a support member; and inserting first and second ends of the cord through the second and third ring members, respectively, from the top side of the panel. The support member is maintained between the first and second ends of the cord and the locking member is secured on the cord sufficiently close to the support member to selectively fix the first ring in a slanted position, with respect to the support member. The above steps are then repeated to selectively position the panel.

20 Claims, 3 Drawing Sheets

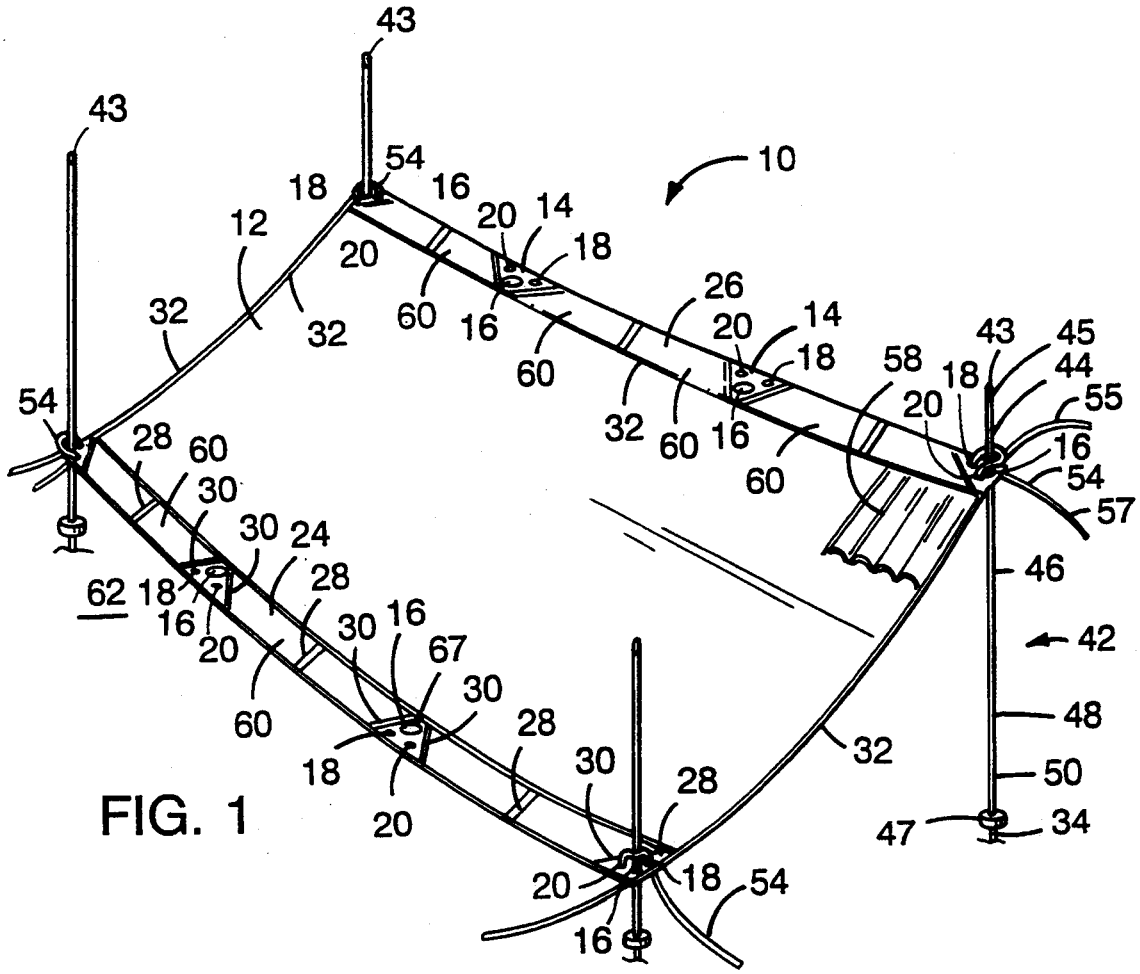
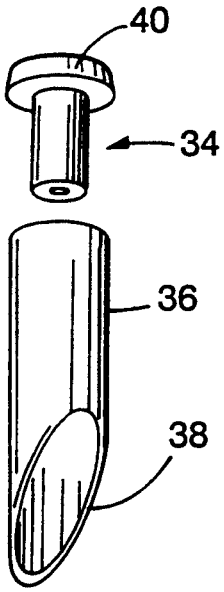
FIG. 2
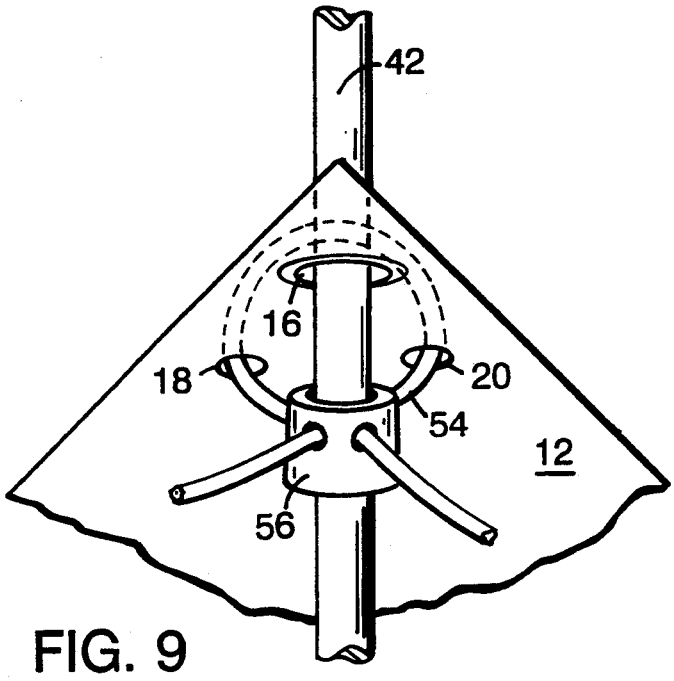
FIG. 9

SHEET SUPPORTING

This invention relates to sheet supporting.

According to one aspect of the invention, a securing structure comprises a first ring member, second and third ring members adjacent to the first ring member, a locking member, a cord insertable through the second and third ring members, respectively, and engagable by the locking member. The first, second and third ring members are seated in a panel, form a triangular relationship and are formed with openings with the opening in the first ring member larger than the openings in the second and third ring members.

According to another aspect of the invention, a free standing panel member comprises a panel; a plurality of ring members in the panel arranged in groups of at least three ring members, each group containing first, second, and third ring members adjacent one another; a plurality of support members insertable into each first ring member; a plurality of anchoring members for accommodating the support members; and a plurality of cords each having a first end and a second end insertable through each second and third ring members, respectively, and engagable by a locking member (e.g., a spring-actuated cord lock).

A method of assembling the invention includes the steps of pushing an anchoring member into a surface sufficiently far to stabilize the anchoring member; inserting a support member into the anchoring member; placing the first ring member over a support member, typically from the bottom of the support; and inserting first and second ends of the cord through the second and third ring members, respectively, from the top side of the panel. The support member is maintained between the first and second ends of the cord, and the locking member is secured on the cord sufficiently close to the support member to selectively fix the first ring in a slanted position, with respect to the support member. The above steps are then repeated to selectively position the panel.

According to another aspect of the invention, a free standing panel member comprises a panel; first, second, and third ring members adjacent one another in the panel; a support member insertable through the first ring member; a-n anchoring member for accommodating the support member; a locking member; and a cord having a first end and a second end insertable through the second and third ring members, respectively, and engagable by the locking member adjacent the support member.

According to another aspect of the invention, a free standing panel member comprises a panel; first, second, and third ring members adjacent one another in the panel; a support member inserted in the first ring member; an anchoring member accommodating the support member; a locking member; and a cord having a first end and a second end inserted in the second and third ring members, respectively, and engaged by the locking member adjacent the support member.

The invention is designed and constructed to be versatile, strong, lightweight, durable, portable and extremely quick and easy to assemble and disassemble. The modular design allows multiple panels to be linked together to increase the area of coverage.

Other features, objectives, and advantages of the invention will become apparent from the following detailed description when read in connection with the accompanying drawings in which:

FIG. 1 is a perspective view of the sheet supported with the panel in one assembled position;

FIG. 2 is a perspective view of the anchoring member;

FIG. 9 is a fragmentary view illustrating a support member inserted in a first ring member engaged by a cord passing through the second and third ring members.

Figure 4:
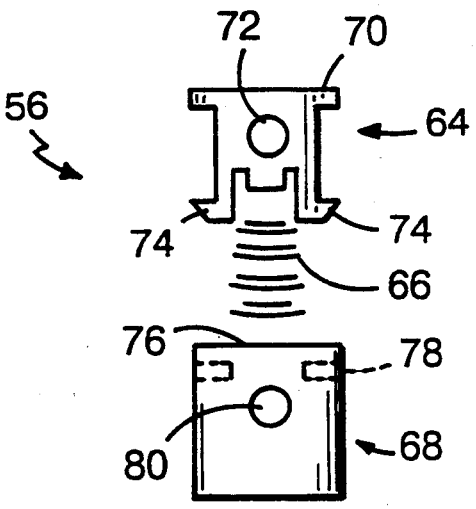
FIG. 4 is an exploded view of the locking member of FIG. 3.

Referring to FIGS. 1 and 2, the sheet supporting assembly 10 has panel 12 with ring member groups 14, each group having first ring member 16, second ring member 18, and third ring member 20, adjacent one another. First ring member 16 has right angled inside edge 17 and is formed with a larger opening than those of second and third ring members 18 and 20, respectively. Panel 12 has folded edges 24 and 26 secured by double cross-stitching 28 and double diagonal-stitching 30. Double diagonal-stitching 30 also strengthens panel 12 around ring member groups 14. Stitching 32 strengthens the edges of panel 12 and helps prevent tearing and fraying. Anchoring members 34 are formed of a hollow tube or footing 36 with tapered end 38 and hollow collar 40.

Figure 3:
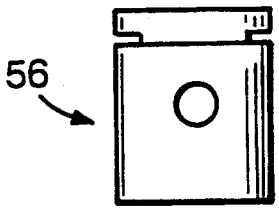
FIG. 3 is a plan view of the locking member.
Figure 5:
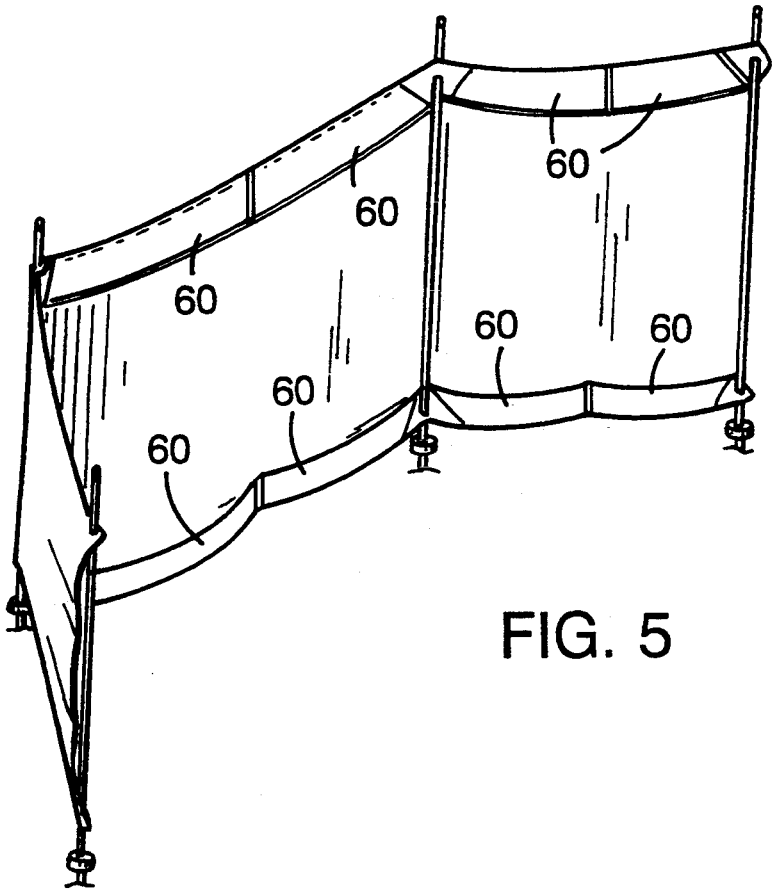
FIGS. 5 and 6 show a perspective view and a plan view, respectively, of the sheet supported with the panel positioned vertically.
Figure 6:
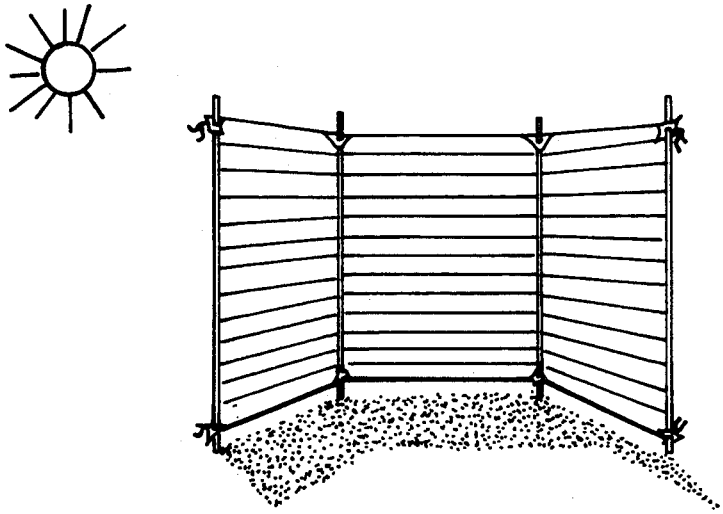
Figure 7:
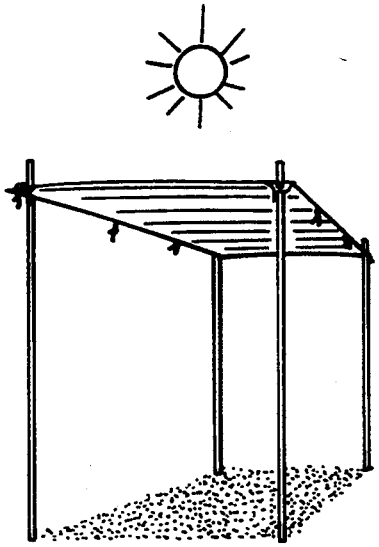
FIG. 7 shows a perspective view of the sheet supported with the panel positioned horizontally.

Collapsible support members 42 having end caps 43 are formed of sections 44, 46, 48, and 50 with flex-cord 52 (not shown), attached at the top of section 44 and bottom of section 50, inserted therethrough. Cords 54 having cord ends 55 and 57 secure panel 12 to collapsible support members 42 with locking members 56, which are preferably quick-releasing and quick-setting cord locks (e.g. spring-actuated cord locks as shown in FIGS. 3 and 4). Panel 12 has first pocket 58, typically for storing footing, and second pockets 60 along the length of folded edges 24 and 26. First pocket 58 stores locking members 56, cord 54, collapsible support members 42, and anchoring members 34. Second pockets 60 may be used to hold material (e.g., sand) to aid in anchoring panel 12 (See FIG. 5).

Referring to FIGS. 3 and 4, locking member 56 has first cylindrical member 64, helical compression spring 66, and second cylindrical member 68. First cylindrical member 64 has cap 70 of diameter larger than the diameter of the body of first cylindrical member 64. First cylindrical member 64 also has opening 72 and clipping structures 74. Second cylindrical member 68 defines a cavity 76 to accommodate first cylindrical member 64 and spring 66. Second cylindrical member 66 also has inner ledge 78 and opening 80.

Locking member 56 is assembled by first placing spring 66 into cavity 76 of second cylindrical member 68 and then urging first cylindrical member 64 into cavity 76, compressing spring 66 until clipping structures 74 engage inner ledge 78. Upon further urging of first cylindrical member 64 into second cylindrical member 68, spring 66 is further compressed, and opening 72 of first cylindrical member 64 aligns with opening 80 of second cylindrical member 68 to create a passage therethrough.

In use, anchoring members 34, collapsible support members 42, cords 54, and locking members 56 are removed from the rolled-up unit. Tapered end 38 of anchoring member 34 is pushed into surface 62, such as sand, sufficiently far to stabilize anchoring member 34. Collapsible support members 42 are extended and one end is inserted through collar 40 first and then footing 36 of the anchoring member 34. The other end is then inserted through first ring member 16 in panel 12. Cord ends 55 and 57 of cord 54, are then inserted through second and third ring members, 18 and 20, respectively, from the top side of panel 12, maintaining support member 42 between cord ends 55 and 57. Cord ends 55 and 57 are finally inserted through aligned holes 72 and 80 of locking member 56 and owing to biasing of spring 66, locking member 56 is locked on cord 54 sufficiently close to support member 42 to selectively fix first ring member 16 in a slanted position, with respect to support member 42. Panel 12 is then selectively positioned using the remainder of the anchoring members 34, support members 42, cords 54, and locking members 56.

Figure 8:
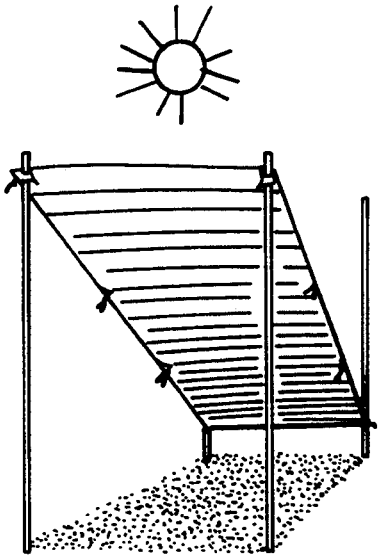
FIG. 8 shows a perspective view of the sheet supported with the panel positioned diagonally.

Referring to FIGS. 5-8, panel 12 may be selectively positioned to protect the user from the elements, and may particularly be positioned vertically (See FIGS. 5 and 6), horizontally (See FIG. 7), or diagonally (See FIG. 8). Panel 12 may be used as a sun screen, a wind screen or as an advertising media.

Referring to FIG. 9, there is shown a fragmentary view with support member 42 inserted through first ring member 16 engaged by cord 54 passing through ring members 18 and 20 in panel secured with locking member 56.

The materials of construction are preferably strong, lightweight, and durable. Panel 12 is typically supplex 100% nylon. First ring member 16 is a 3/8" I.D. brass grommet with a right angled inside edge. Second and third ring members, 18 and 20, are 3/16" I.D. brass grommets. Each collapsible support member 42 is formed of four 13" long and 3/8" I.D.×035" wall thickness aluminum poles with each section connected by 2" long and ¼" I.D.×0.035" wall thickness aluminum tube connectors. Flex-cord 52 is 3/16" diameter and 40" long elastic cord. End caps 43 are dipped vinyl. Anchoring members 34 are 11" long and ¾" I.D.×0.125" wall thickness extruded aluminum tube. Collar 40 is molded ABS (acrylonitrile butadiene styrene resin). Locking members 56 are formed of plastic, and helical compression spring 66 is steel.

Other embodiments are within the claims.

What is claimed is:

1. Apparatus assembleable into a securing structure comprising:

a panel;

a first ring member in said panel;

second and third ring members closely adjacent to said first ring member in said panel;

said first, second and third ring members seated in said panel forming a triangular relationship and formed with openings with the opening in said first ring member larger than the openings in said second and third ring members;

a locking member;

a cord insertable through said second and third ring members separate from and engagable by said locking member.

2. The apparatus of claim 1 and further comprising a support member insertable through said first ring member.

3. The apparatus of claim 1 and further comprising a support member insertable through said first ring member, wherein said locking member is engagable with said cord sufficiently close to said support member to selectively fix said first ring member in a slanted position with respect to said support member.

4. The apparatus of claim 1 wherein said first ring member has a rounded inside edge.

5. The apparatus of claim 1 wherein said locking member comprises a spring actuated lock.

6. The apparatus of claim 5 wherein said spring actuated lock comprises:

a spring having a first end and a second end;

a first cylindrical member having a first end, a middle section, and a second end, said first end having a cap of diameter larger than the diameter of said first cylindrical member, said middle section having an opening, and said second end having clipping structures and engaging said first end of said spring; and a second cylindrical member defining a cavity to accommodate said first cylindrical member and said spring, said second cylindrical member having a first end, a middle section, and a second end, said first end being open and having an inner ledge, said middle section having an opening, and said second end being closed;

said second cylindrical member engaging said second end of said spring such that as said first cylindrical member is urged into said second cylindrical member compressing said spring, said first cylindrical member clipping structures engage said inner ledge in said first end of said second cylindrical member and upon further urging, said opening in said first cylindrical member aligns with said opening of said second cylindrical member.

7. The apparatus of claim 6 wherein said first and second cylindrical members are plastic.

8. The apparatus of claim 1 wherein said first, second, and third ring members are brass.

9. Apparatus assembleable into a free standing panel member comprising:

a panel having a top side, a bottom side and a peripheral edge;

a plurality of ring members in said panel arranged in groups of at least three ring members, each group containing first, second, and third ring members closely adjacent one another;

said first, second and third ring members seated in said panel forming a triangular relationship and formed with openings with the opening in said first ring member larger than the openings in said second and third ring members;

a plurality of support members insertable into a respective one of said first ring members;

a plurality of anchoring members constructed and arranged to engage respective ones of said support members;

a plurality of locking members; and a plurality of cords each having a first end and a second end insertable through each said second and third ring members, respectively, and engagable by one of said locking members.

10. The apparatus of claim 9 wherein said panel is collapsible; has a first pocket for storing said supporting members, said anchoring members, and said cord; and a second pocket along said peripheral edge of said panel.

11. The apparatus of claim 9 wherein said panel member is nylon.

12. The apparatus of claim 9 wherein said support members are collapsible.

13. The apparatus of claim 12 wherein said support members are aluminum.

14. The apparatus of claim 9 wherein each of said anchoring members comprises:

a hollow tube engagable with one of said support members, said hollow tube having a first end and a second end;

said first end being tapered.

15. The apparatus of claim 14 wherein said second end of said hollow tube engages a hollow collar.

16. The apparatus of claim 14 wherein said hollow tube is aluminum.

17. The apparatus of claim 9 wherein said locking member comprises a spring actuated lock.

18. The panel member of claim 10 wherein said anchoring members are stored in said first pocket.

19. A free standing panel member comprising:

a panel;

first, second, and third ring members adjacent one another in said panel;

said first, second and third ring members seated in said panel forming a triangular relationship and formed with openings with the opening in said first ring member larger than the openings in said second and third ring members;

a support member inserted through said first ring member;

an anchoring member engaging said support member;

a locking member; and a cord having a first end and a second end inserted through said second and third ring members, respectively, separate from and engaged by said locking member adjacent said support member.

20. A free standing panel member comprising:

a panel;

first, second, and third ring members adjacent one another in said panel;

said first, second and third ring members seated in said panel forming a triangular relationship and formed with openings with the opening in said first ring member larger than the openings in said second and third ring members;

a support member inserted in said first ring member;

an anchoring member engaging said support member;

a locking member; and a cord having a first end and a second end inserted in said second and third ring members, respectively, separate from and engaged by said locking member adjacent said support member.

* * * * *